United States Patent [19]

Pearl

[11] Patent Number: 4,665,619

[45] Date of Patent: May 19, 1987

[54] METHOD AND APPARATUS FOR WORKING ON SHEET MATERIAL

[75] Inventor: David R. Pearl, West Hartford, Conn.

[73] Assignee: Gerber Garment Technology, Inc., South Windsor, Conn.

[21] Appl. No.: 460,314

[22] Filed: Jan. 24, 1983

[51] Int. Cl.[4] ..... B65H 17/36; B43L 13/00

[52] U.S. Cl. ..... 33/32.4; 33/1 M; 33/32.3; 226/8

[58] Field of Search ..... 33/20 R, 18 R, 19 R, 33/23 R, 23 B, 32 C, 32 F, 32 G, 1 M, 1 AA, 35, 34, 32 E, 26; 226/8; 83/319; 346/118

[56] References Cited

U.S. PATENT DOCUMENTS

| | | | |
|---|---|---|---|
| 3,193,943 | 7/1965 | Moore, Sr. | 33/32 C |
| 3,570,445 | 3/1971 | Johnson | 33/1 M |
| 3,844,461 | 10/1974 | Robinson et al. | 33/1 M |
| 4,131,224 | 12/1978 | Gerber et al. | 226/8 |
| 4,221,150 | 9/1980 | Bergfelt et al. | 33/32 C |
| 4,315,371 | 2/1982 | Kotani et al. | 33/1 M |

*Primary Examiner*—Willis Little

*Attorney, Agent, or Firm*—McCormick, Paulding & Huber

[57] ABSTRACT

A method and apparatus for working on sheet material utilizes a table having two spaced coplanar lips across which sheet material is stretched to be worked on by a tool supported from a movable carriage spanning the table. Clamping units attached to the table hold the sheet material in a taut condition between the coplanar lips of the table by clamping the material against the lips. A platen is suspended from the carriage on the side of the material opposite from the work tool for movement with the carriage and provides a backing for the material as the work tool performs a work operation on the material. The apparatus is particularly suited for applications in which the sheet material in an elongated strip is indexed in segments across the work area of the table.

17 Claims, 6 Drawing Figures

METHOD AND APPARATUS FOR WORKING ON SHEET MATERIAL

BACKGROUND OF THE INVENTION

The present invention relates generally to a method and apparatus for performing a work operation on limp sheet material and relates more particularly to apparatus having a table across which sheet material is held in a spread condition while a work tool in the apparatus performs a work opertion on the material.

Prior art apparatus for working on limp sheet material such as cloth, paper and the like, frequently includes a work table having a flat bed defining a support surface on which sheet material is spread. A work tool or instrument which is supported on a carriage above the support surface performs a work operation on the material. Typically, the carriage is movable over the support surface in one coordinate direction parallel to the support surface while the instrument, mounted on the carriage is movable relative to the carriage and the support surface in another coordinate direction parallel to the surface. Composite movements of the carriage and instrument allow the instrument to be translated to any coordinate position over the region of the support surface traversed by the carriage. Accurate positioning of the carriage and the instrument supported thereby may be achieved by numerical controls which operate either from an on-line data generator or from previously programmed data. The apparatus may be provided with a wide variety of work tools, such as for example, plotting pens or styluses, ink jet nozzles, light heads, tracking heads and cutting or drilling tools.

The work table of the prior art apparatus commonly includes a bed of material defining a support plane on which sheet material to be worked is laid in spread condition. The material comprising the bed may be any of a number of support materials, such as, for example, hard sheet steel having a smooth planar surface or, as described in U.S. Pat. No. 3,477,322, a resilient rubber platen. A characteristic that each of these support-surface or plane-defining beds has in common is that adjacent areas of the bed defining the material support plane are very close to, if not in contact with, one another so that every region of sheet material spread over the support surface is supported by a portion of bed material in engagement with one side of the spread sheet material. Although beds of this type may provide a firm support plane for the sheet material spread thereon, the bed material may represent a large portion of the total cost of the apparatus table. In manufacturing the tables, the support plane of the bed must be smoothed and precisely leveled within limited tolerances to cooperate with the tool. The bed must also be fabricated from materials that withstand shipping and handling, and care must be exercised to prevent damage to the bed surface when the apparatus is in and out of use.

The span of the material support surface defined by the beds of the prior art may be relatively short compared to the length of a strip of sheet material to be worked on. Therefore, to permit a work tool to complete a work operation on the entire strip of material, the material must be indexed or shifted across the support surface in segments by suitable indexing means. An example of an apparatus with indexing means for performing such an indexing operation is a plotting machine described in U.S. Pat. No. 3,844,461. Commonly, the bed remains stationary while the material is indexed relative to the support surface thereby creating friction between the support surface and the strip of material moved relative thereto. If the friction created during an indexing operation can be reduced, then the required power and the cost of components performing the operation will be reduced.

It is accordingly an object of this invention to provide an apparatus for working on limp sheet material and having an improved table which is less costly than tables of the prior art.

It is a further object of this invention to provide a method and apparatus having an improved table across which limp sheet material may be indexed in segments with much less friction than is created in the apparatus of the prior art.

SUMMARY OF THE INVENTION

The present invention resides in a method and apparatus for working on limp sheet material having an improved table across which the material is stretched while a work tool supported from a carriage spanning the table performs a work operation on the material.

The apparatus includes a table having spaced coplanar lips between which sheet material is stretched, the coplanar lips defining an open material spanning space and a material support plane extending in first and second coordinate directions. Retaining means are connected to the table for holding the material stretched across the material spanning space between the lips in the support plane. A carriage is mounted on the table for movement in the first coordinate direction relative to the table and sheet material. A work tool for performing a work operation on the material is supported by the carriage, and in one embodiment, the tool is mounted for movement in the second coordinate direction of the support plane relative to the carriage.

The apparatus preferably includes material backing means suspended from the carriage on the side of the material support plane opposite the tool for movement with the carriage in the first coordinate direction. The backing means provides support for the material in the support plane while the tool performs a work operation on the material.

DETAILED DESCRIPTION OF THE PREFERRED EMBODIMENTS

Figure 1:
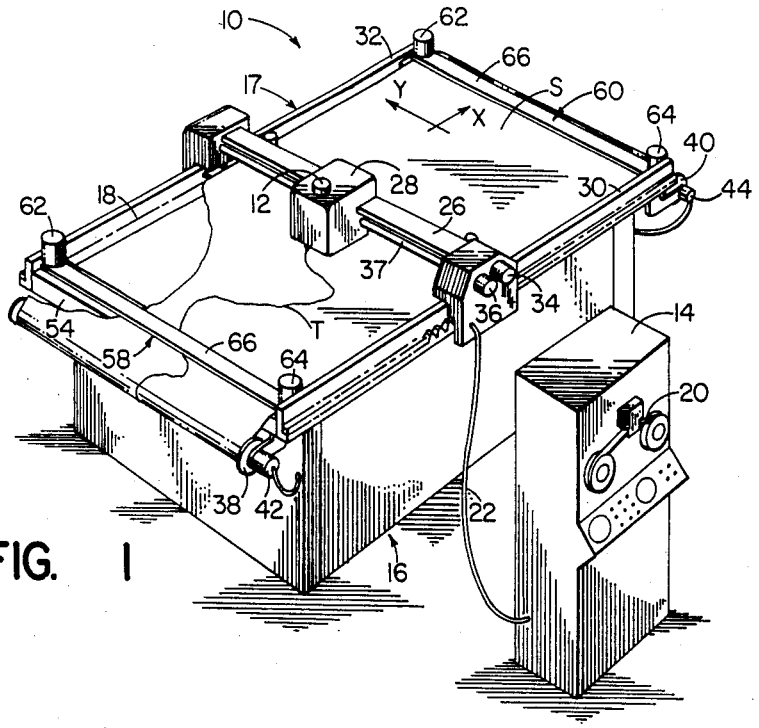
FIG. 1 is a perspective view of an automatically controlled plotting apparatus in which the present invention is embodied.

FIG. 1 shows an automatically controlled plotting apparatus, generally designated 10, which comprises one environment for the present invention. The plotting apparatus includes a plotting instrument or head 12 which produces graphic information on a strip S of limp sheet material formed, for example, of plotting paper in a single ply or multiple plies with carbon tissue in between. Although a plotting apparatus has been selected for illustration of the invention, it should be understood that the invention may be employed in and has utility in any type of automatically controlled system having an instrument or tool supported on a carriage for positioning over a strip of sheet material that is held stationary relative to the carriage during operation of the tool. Thus, the invention may be employed in systems having photoexposure heads, tracking heads, and numerous other tools.

The automatically controlled plotting apparatus is comprised basically of a controller 14 which generates plotting commands and a plotter 16 which responds to the commands and causes the plotting head 12 to draw graphic information on the strip S supported on the plotter table 17 in a spread condition. The controller 14 reads a plotting program from a punched or magnetic tape 20 and converts the program into motor commands that are transmitted to drive motors on the plotter 17 by way of a connecting cable 22.

The plotting head 12 is suspended over the table 17 above the material support plane, illustrated in FIG. 1 by a broken line along its edge and designated 18, by means of an X-carriage 26 and a Y-carriage 28. The X-carriage 26 translates back and forth in the illustrated X-coordinate direction on a set of racks 30 and 32 which are engaged by an X-drive motor 34 energized by command signals from the controller 14. The Y-carriage 28 is mounted on the X-carriage 26 for movement relative to the X-carriage in the Y-coordinate direction and is translated by the Y-drive motor 36 and a lead screw 37 connected between the motor and carriage. Like the drive motor 34, the drive motor 36 is also energized by command signals from the controller 12. Composite motions of the carriages 26 and 28 permit the plotting head 12 to be translated to any coordinate position over the spread sheet material S in the material support plane 18.

Figure 4:
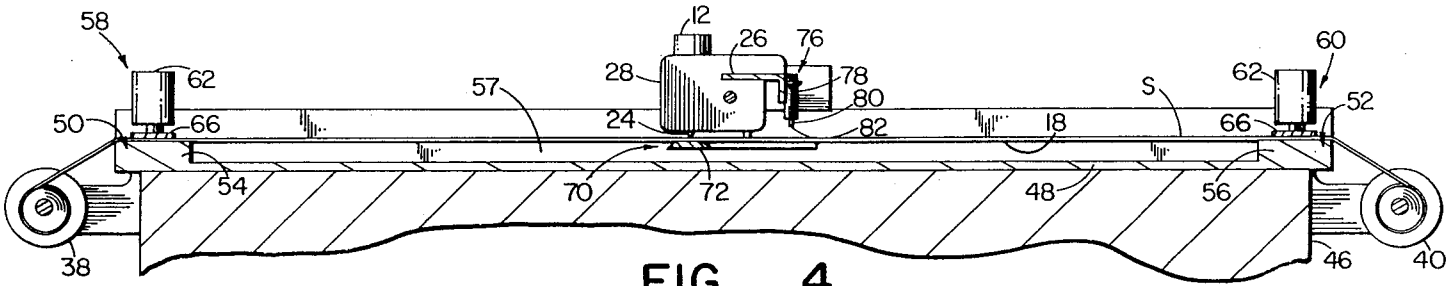
FIG. 4 is a sectional view taken along line 4—4 of FIG. 2.
Figure 6:
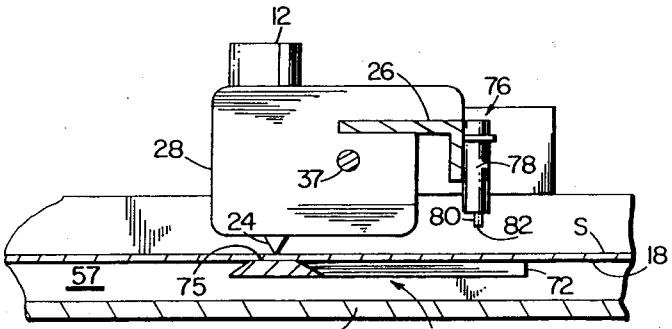
FIG. 6 is similar to FIG. 5, but shows the work tool of the instrument head and the plunger of the coupling unit in different positions.
Figure 5:
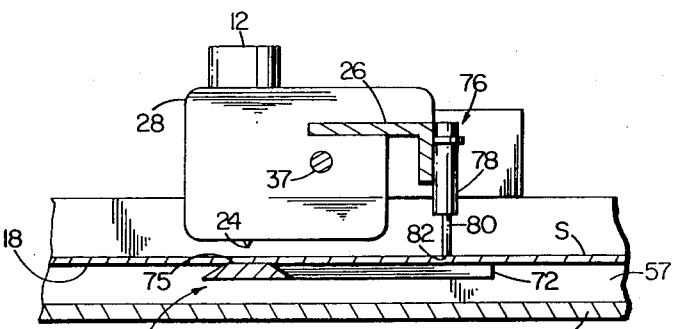
FIG. 5 is an enlarged view of the instrument head and carriage of FIG. 4 with the work tool in an operative position and the plunger of the frictional coupling unit in a release position.

With reference to FIGS. 4–6, the plotting head 12 contains a work tool 24 in the form of a plotting pen which is actuated whenever a line trace T or other graphic image is to be placed on the strip S of plotting material. The pen is supported for movement toward and away from the plotting material, and actuating mechanisms (not shown) in the head and which are operatively connected between the pen 24 and the controller 14 move the pen 24 between a raised position above the material, as shown in FIG. 6, and a lowered position in plotting engagement with the material, as shown in FIG. 5, in response to commands from the controller 14.

Figure 3:
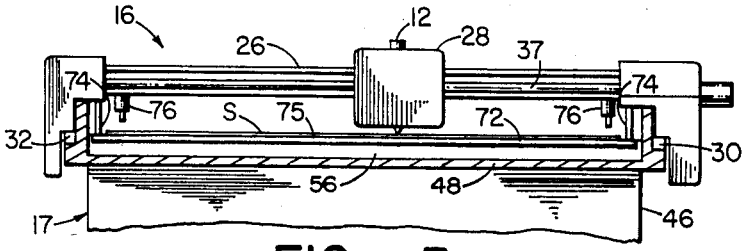
FIG. 3 is a sectional view taken along line 3—3 of FIG. 2.

In accordance with this invention and with reference to FIG. 4, the table 17 is bedless and includes spaced coplanar lips 50 and 52 defining the material support plane 18. In the illustrated plotting apparatus 10, the coplanar lips 50 and 52 are formed as raised, straight and parallel aprons 54, 56 at opposite ends of a table top 48. The upper surfaces of the aprons are flat and coplaner to effectively define the material support plane 18. As indicated in FIG. 3, the raised apron 56 is elongated and extends across the entire end of the table 17 in the Y-coordinate direction, and the apron 54 at the opposite end is similarly formed. Between the two aprons, the table top defines an opening or space 57 which is spanned in FIGS. 4–6 by the strip of sheet material when stretched between the coplanar upper surfaces of the lips 50, 52. The upper surfaces of the aprons are preferably smooth and hard, and have a low coefficient of friction with the sheet material to allow the spanning material to be placed in tension for support substantially within the material support plane 18 as shown. Materials such as steel, aluminum, FORMICA, or plastic may be used to construct the raised aprons.

Figure 2:
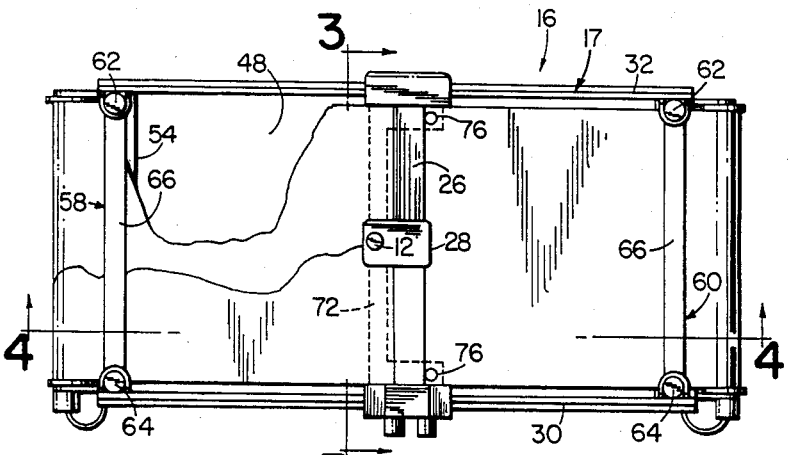
FIG. 2 is a top plan view of the plotting apparatus in FIG. 1.

As shown in FIGS. 1, 2 and 4, the strip S of plotting paper is supported on rolls or feed spools 38 and 40 held respectively by brackets at opposite longitudinal ends of the table 17. A torque motor 42 is drivably connected with one spool 38 and another torque motor 44 is drivably connected with the other spool 40 to place a section of plotting paper in a taut condition between the coplanar lips 50 and 52 of the plotting table. Operation of the torque motors 42, 44 is regulated by the controller 14.

To ensure that the segment of plotting material between the table lips 50, 52 remains in a taut condition in the material support plane while the plotting head 12 performs a plotting operation on the material, retaining means are provided in the apparatus 10 for tightly holding the material at each of the longitudinal ends of the table. As best shown in FIGS. 1, 2 and 4, the retaining means are provided by two clamping mechanisms, designated respectively 58 and 60, supported by the table on the side of the material support plane opposite the table lips 50 and 52 for engaging and holding the material tightly against the respective table lips. Each clamping mechanism includes two clamping motors, or electrical solenoids 62, 64, fixed to opposite sides of the table and an elongated clamping bar 66 suspended at each end from the reciprocable armatures of the solenoids 62, 64. Each elongated bar 66 has a planar surface oriented so as to face its associated table lip. While the solenoids are fixed on the table relative to the material support plane, their reciprocable armatures are permitted to move along axes generally perpendicular to the plane and move the clamping bar 66 in and out of clamping engagement with the material S.

In operation, the solenoids 62, 64 of each clamping mechanism 58, 60 are energized in synchronism by the controller 14 to move the elongated bars 66 into clamping engagement with the plotting material overlying an associated table lip. Preferably, the planar surface of each bar 66 is a high friction surface so that when the bar is in a clamping position with the material, the high friction surface is in frictionally gripping engagement with one side of the material spread in the support plane with the other side of the material in direct contact with the opposing portion of the table lip. A return spring within each solenoid pulls the arm 66 upwardly and away from the material when the solenoids are de-energized. When the bar 66 is moved away from the material support plane, its planar surface moves out of frictional gripping engagement with the material.

Referring to FIGS. 2–6, material backing means, designated 70, is suspended from the X-carriage 26 on the side of the material support plane opposite from the instrument head 12 for movement with the carriage in the X-coordinate direction. The material backing means is provided by a platen 72 having a C-shape as viewed in plan form in FIG. 2. The platen is supported from the X-carriage 26 by side plates 74, 74 extending vertically between the platen 72 and the underside of the carriage 26 as best shown in FIG. 3. The length of the elongated platen and the spacing between the plates 74, 74 are sufficient to accommodate the width of strip S of plotting material. The platen 72 has an elongated center portion defining a planar surface 75 extending in the Y-coordinate direction adjacent the material support plane and is located with the surface 75 directly opposite the path of motion of plotting tool 24 along the X-carriage 26. It will be understood, therefore, that some portion of the planar surface 75 of the platen 72 is always located directly beneath or in alignment with the plotting tool 24 regardless of the position of the plotting head 12 along the Y-coordinate axis. The planar surface 75 of the platen located in this manner provides a supportive backing for the material in the support plane while the tool performs a plotting operation on the material. Although the platen surface 75 provides a suitable material backing for plotting tools which never come into contact with the material during a plotting operation, such as, for example, an ink jet nozzle, the platen surface is particularly intended to serve as a material support backing for plotting tools, such as pens or styluses, which must be pressed against the material during a plotting operation. For this reason, the platen is preferably made of a low friction material like the raised aprons 54, 56 so that the sheet material S slides easily over the platen as the X-carriage 26 and the plotting head 12 move back and forth in the X-coordinate direction during a plotting operation.

The plotting apparatus 10 operates on a limited segment of the strip S of plotting material at any one time, that segment being the portion of paper held taut between the two table lips 50 and 52. Indexing means are included in the plotting apparatus 10 for precisely indexing or shifting the material across the lips. Thus, the plotting tool 24 of the plotting head 12 may operated on successive segments of the strip and generate a continuous plot or trace T. As shown in FIGS. 1–3, the indexing means includes a pair of frictional coupling units 76, 76 mounted at opposite ends of the X-carriage 26 for releasably coupling the strip of material to the X-carriage. When coupled to the carriage 26, the material is shifted across the open space 57 as the carriage 26 is moved in the X-coordinate direction.

Referring to FIGS. 4–6, each coupling unit 76 includes a drive motor or electrical solenoid 78 with a movable part or plunger 80. A friction shoe 82 made from high-friction material, such as rubber, cork or the like, is mounted in fixed position at the lower end of the plunger 80 and has a high-friction surface generally parallel to and facing the material support plane 18. The plunger 80 is movable generally toward and away from an opposing portion of the platen 72 between coupled and release positions. When the coupling unit 76 is in its coupled position as shown in FIG. 6, the high-friction shoe 82 of the plunger 80 is disposed in frictional gripping engagement with the upper surface of the material S overlying the platen 72, the lower surface of the material being in direct contact with the lateral extremity of the platen below the opposing shoe 82.

Movement of the X-carriage from one longitudinal end of the table to the other by means of the drive motor 34, while the coupling units 76, 76 are in their coupled position and the clamping mechanisms 58, 60 are deenergized, advances or indexes the strip of material S across the table and positions a new segment over the opening 57. To keep the material suspended generally in the support plane 18 during indexing, the torque motors connected with the feed spools 38, 40 are appropriately energized to apply tension to the strip. The motors are deenergized after indexing is complete and the clamping mechanisms 58, 60 are energized. When each coupling unit 76 is moved to its release position as shown in FIGS. 4 and 5, the friction shoe 82 is disposed a substantial distance above the material support plane so that its high-friction surface is out of frictional engagement with the material and the X-carriage is again free to continue the plotting operation.

During a plotting operation performed on a segment of the strip S, the material is held fixedly in a work position stretched across the table opening 57 substantially in the support plane 18 by the clamping mechanisms 58, 60 in their clamping positions. The plotting head 12 generates a trace T on the segment in response to tool positioning signals received from the controller 14. Throughout the plotting operation, the frictional coupling units 76, 76 are arranged in their release position and their plungers 80, 80 are, accordingly, shown in FIGS. 4 and 5 spaced above the plotting material. When the head 12 has completed its operation on the segment, the plotting pen 24 is lifted out of engagement with the material and the X-carriage 26 is moved to one end of the table. A signal from the controller 14 moves the plungers 80, 80 of the coupling units 76, 76 into their coupled position, and the clamping mechanisms 58, 60 are de-energized to unclamp the strip at the ends of the table. The X-carriage 26 which is now frictionally coupled to the material by the coupling units 76, 76 advances the material toward the opposite end of the table, thereby bringing another segment of the strip into the work area of the head. The X-carriage 26 halts upon reaching the opposite longitudinal end of the table or some other desired position. The clamping mechanisms 58, 60 are then re-energized to hold the new segment of material stretched across the table lips. The plungers 80, 80 of the coupling units 76, 76 are then moved on signals from the controller to their release positions and further controller signals cause the X-carriage 26 and Y-carriage 28 to position the plotting pen 24 in plotting engagement with the material and resume plotting.

It will be understood that numerous modifications may be had to the aforedescribed embodiment of the apparatus without departing from the spirit of the invention. For example, although the retaining means comprised by the clamping mechanisms operates directly on the sheet material, other mechanisms such as brakes operating on the feed spools may also hold the material in tension. Alternatively, one brake or clamp and the tension produced by one of the torque motors connection with the spools can be relied upon. Also, to minimize friction with the sheet material, the underlying backing means may be a roller suspended for movement with the X-carriage in registration with the tool. Accordingly, the embodiment described herein is intended as an illustration and not as a limitation of the invention.

What is claimed is:

1. A bedless apparatus for working on limp sheet material comprising:

a support table having spaced coplanar lips defining therebetween an open material-spanning space and a material support plane extending in first and second coordinate directions;

retaining means connected to the table for holding limp sheet material stretched across the material spanning space between the coplanar lips in a taut condition substantially within the material supporting plane;

a tool carriage mounted on the support table for movement relative to the table and stretched sheet material in the first coordinate direction; and a work tool supported for movement with the tool carriage in the first coordinate direction and positioned for performing a work operation on the sheet material stretched across the material spanning space between the coplanar lips.

2. A bedless apparatus for working on sheet material as defined in claim 1 further including material backing means also mounted on the carriage for movement in the first coordinate direction and positioned on the side of the material support plane opposite from the tool.

3. An apparatus as defined in claim 1 wherein the table has two spaced coplanar lips, each generally straight and arranged parallel to one another.

4. An apparatus as defined in claim 1 wherein the coplanar lips include two elongated members each defining a surface over which the sheet material is stretched.

5. An apparatus as defined in claim 4 wherein the retaining means includes two clamping mechanisms supported respectively adjacent the two elongated members for engaging and holding the material against the lips in stationary relationship with the table.

6. An apparatus as defined in claim 1 wherein the retaining means includes at least one frictional clamping mechanism associated with one of the defined coplanar lips, the clamping mechanism including a movable member having a high-friction surface and means for moving the member generally toward and away from an opposing portion of the associated lip between a clamped position and an unclamped position.

7. An apparatus as defined in claim 2 wherein the material backing means includes an elongated member defining a smooth support surface extending in the second coordinate direction and positioned adjacent the material support plane.

8. An apparatus as defined in claim 7 wherein the work tool is supported on the carriage for movement along a path in the second coordinate direction relative to the table and stretched sheet material; and the elongated member is located in parallel with the path of movement of the work tool so that when the tool is moved in the second coordinate direction relative to the table, the work tool remains in overlying relationship with the elongated member.

9. An apparatus as defined in claim 1 further comprising means for indexing the sheet material between two work positions, the indexing means including releasable coupling means supported by the carriage for coupling the material to the carriage and movement of the material in the first coordinate direction with the carriage.

10. An apparatus as defined in claim 9 wherein a material backing means is mounted on the carriage for movement in the first coordinate direction and suspended from the carriage in a position adjacent the material support plane; and the releasable coupling means includes a coupling unit supported on the one side of the material support plane opposite the material backing means to engage and hold the material against the backing means in stationary relationship with the carriage.

11. An apparatus as defined in claim 10 wherein the coupling unit includes a friction shoe having a high-friction surface and means for moving the friction shoe generally toward and away from an opposing portion of the material backing means between a coupled position wherein the high-friction surface is in frictionally gripping engagement with one side of the sheet material spread in the material support plane and with the other side of the material in engagement with the opposing portion of the material backing means, and an uncoupled position wherein the high-friction surface is out of frictional gripping engagement with the one side of the material.

12. A method of working on a limp sheet material comprising:

providing a bedless work table defining a central opening extending in a first coordinate direction between opposite ends of the table and in a second coordinate direction perpendicular to the first coordinate direction, the two coordinate directions defining a table work plane for limp sheet material;

stretching limp sheet material between the opposite ends of the table and across the central opening of the table substantially in the table work plane; and moving a work tool mounted on the table back and forth over the limp sheet material stretched between the opposite ends of the table while the tool performs work upon different areas of the sheet material.

13. A method of working on limp sheet material as defined in claim 12 further including suspending a backing member in the central opening on the side of the limp sheet material opposite from the work tool; and moving the backing member in coordination with the tool during a work operation to provide support for the limp sheet material in the different areas being worked.

14. A method of working on limp sheet material as defined in claim 13 wherein the step of moving the backing member includes coupling the backing member with the work tool for joint movement between the ends of the table.

15. A method of working on limp sheet material as defined in claim 12 further including providing a material engaging member movable back and forth across the central opening of the table;

coupling the engaging member with the limp sheet material between work operations by the tool; and indexing the coupled sheet material across the table by moving the engaging member and coupled sheet material across the central opening; and releasing the engaging member from the limp sheet material after a new segment of the material is located in the work plane between the ends of the table.

16. A method of working on a limp sheet material as defined in claim 15 wherein the step of stretching includes maintaining tension on the sheet material during the step of indexing to hold the material substantially in the table work plane as the engaging member moves across the central opening.

17. A method of working on limp sheet material as defined in claim 15 wherein:

the step of providing a material engaging member comprises providing an elongated member movable back and forth in the first coordinate direction between the ends of the table and extending across the central opening in the second coordinate direction, the member having a material supporting surface lying substantially in the table work plane; and an additional step includes moving the elongated member while uncoupled from the sheet material back and forth under the sheet material in correspondence with the work tool to provide support for the material in the different areas being worked.

* * * * *